US005179908A

United States Patent [19]

Hebels

[11] Patent Number: 5,179,908

[45] Date of Patent: Jan. 19, 1993

[54] APPARATUS FOR DRYING A MOISTURE-CONTAINING LAYER AT ONE SIDE OF A RUNNING SUBSTRATE

[75] Inventor: Albert Hebels, Kellinghusen, Fed. Rep. of Germany

[73] Assignee: Pagendarm GmbH, Hamburg, Fed. Rep. of Germany

[21] Appl. No.: 682,723

[22] Filed: Apr. 9, 1991

[30] Foreign Application Priority Data

Apr. 14, 1990 [DE] Fed. Rep. of Germany ..... 4012176

[51] Int. Cl.[5] ..... F26B 3/00

[52] U.S. Cl. ..... 118/68; 34/114

[58] Field of Search ..... 118/62, 68, 69; 34/114, 34/156

[56] References Cited

U.S. PATENT DOCUMENTS 4,231,164 11/1980 Barbee ..... 118/68
4,365,425 12/1982 Gotchel ..... 118/68
4,764,402 8/1988 Pagendarm ..... 427/355
4,886,564 12/1989 Pagendarm ..... 156/230

*Primary Examiner*—W. Gary Jones
*Assistant Examiner*—Charles K. Friedman
*Attorney, Agent, or Firm*—Peter K. Kontler

[57] ABSTRACT

The uncoated side of a running web-shaped substrate, the other side of which carries a layer containing an evaporable solvent, is contacted by at least one idler guide roller which is rotated by the substrate. The angle of contact between the uncoated side of the substrate and the peripheral surface of the guide roller is increased by streams of compressed conditioning gas which is discharged by the orifices of two venturis one of which is located immediately upstream of the guide roller and directs gas counter to the direction of advancement of the substrate. The other venturi is located immediately downstream of the guide roller and its orifice discharges gas in the direction of advancement of the substrate.

7 Claims, 1 Drawing Sheet

APPARATUS FOR DRYING A MOISTURE-CONTAINING LAYER AT ONE SIDE OF A RUNNING SUBSTRATE

BACKGROUND OF THE INVENTION

The invention relates to apparatus for treating running webs or strips of flexible material. More particularly, the invention relates to improvements in apparatus for treating (especially drying) web- or strip-shaped substrates which are coated at one side, e.g., with one or more layers of an adhesive substance containing a surplus of moisture (such as an evaporable solvent) which must be expelled prior to further treatment of the substrate.

It is known to train a coated web-like substrate over one or more rotary guide members in the form of rollers or drums while the substrate is being treated with a gaseous fluid, e.g., with a heated gas which is to expel moisture from the substrate and/or from its coat or coats. Apparatus of such character are known as drum type dryers and are often used to expel solvent from one or more layers which are applied to one side of a running substrate. Expulsion of moisture (such as an evaporable solvent) entails a solidification of the applied layer or layers. As a rule, the gaseous conditioning medium is caused to impinge directly upon the outer side of the single layer or upon the outer side of the outermost layer at one side of the running substrate. This entails rapid drying of the material at the exposed side of the single layer or at the exposed side of the outermost layer, and the thus obtained hardened film prevents evaporation of moisture from the inner stratum or strata of the layer or layers. Thus, the moisture which is caused to evaporate in the inner stratum or strata of the layer or layers at one side of the substrate is entrapped between the substrate and the hardened film at the outer side of the single layer or at the outer side of the outermost layer or layers.

The temperature of the gaseous conditioning medium can be lower than the temperature of the substrate, for example, if the temperature of the substrate has been raised during the preceding drying of the applied layer or layers. Such conditioning step then constitutes an additional operation which must be carried out prior to further processing of the substrate and contributes to the overall cost of the combined coating and conditioning operation.

OBJECTS OF THE INVENTION

An object of the invention is to provide an apparatus wherein the drying medium can perform at least one additional function.

Another object of the invention is to provide an apparatus wherein the guide means for a running coated substrate can be driven in a novel and improved way.

A further object of the invention is to provide an apparatus wherein the drying medium can effect a more predictable and more satisfactory expulsion of solvents and/or other evaporable substances than in heretofore known apparatus.

An additional object of the invention is to provide an apparatus wherein the substrate and its coat or coats are treated gently and the expulsion of moisture from the substrate and/or its coat or coats can be carried out more efficiently than in conventional apparatus.

Still another object of the invention is to provide a novel and improved method of treating a moisture-carrying flexible substrate.

A further object of the invention is to provide the above outlined apparatus with novel and improved means for contacting the substrate with a gaseous conditioning fluid.

SUMMARY OF THE INVENTION

One feature of the present invention resides in the provision of an apparatus for treating a coated web- or strip-shaped running substrate which has a coated side and an uncoated side and is advanced in a predetermined direction along a predetermined path. The apparatus comprises at least one rotary guide member (preferably an idler roller or drum, hereinafter called roller) adjacent a predetermined portion of the path at the uncoated side of the running substrate, and means for directing a compressed gas against the uncoated side of the substrate adjacent the at least one guide roller upstream and downstream of the predetermined portion of the path.

The apparatus preferably further comprises means for conditioning (heating or cooling) the gas before the gas contacts the uncoated side of the running substrate in the path.

The directing means can include a first venturi upstream and a second venturi downstream of the predetermined portion of the path. The arrangement is preferably such that the first venturi has at least one first orifice which discharges gas counter to the predetermined direction and the second venturi has at least one orifice which discharges gas in the predetermined direction. The venturis are or can be mirror images of each other with reference to a plane which includes the axis of the at least one guide roller and extends transversely of the path for the substrate.

The apparatus preferably further comprises means for pulling the substrate along the path at a variable speed.

The at least one guide roller is preferably an idler roller which defines with the adjacent venturis first and second suction chambers adjacent the peripheral surface of the guide roller upstream and downstream of the predetermined portion of the path so that suction in the chambers attracts the uncoated side of the substrate and the uncoated side contacts a substantial portion of the peripheral surface of the guide roller (e.g., along an arc of approximately 90°) to rotate the guide roller without slippage relative to the substrate.

The path can be located above or below the guide roller or rollers.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
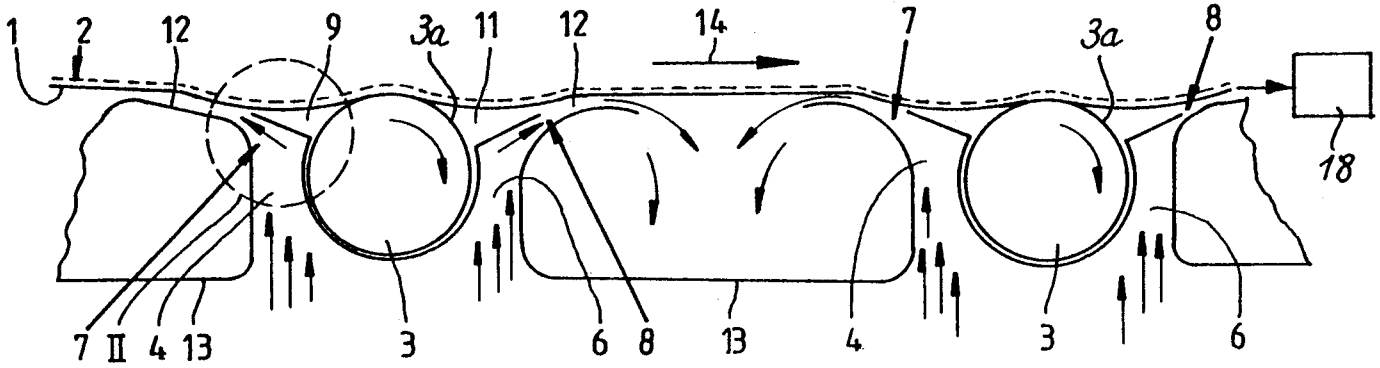
FIG. 1 is a fragmentary schematic elevational view of an apparatus which embodies one form of the invention and comprises several guide rollers.
Figure 2:
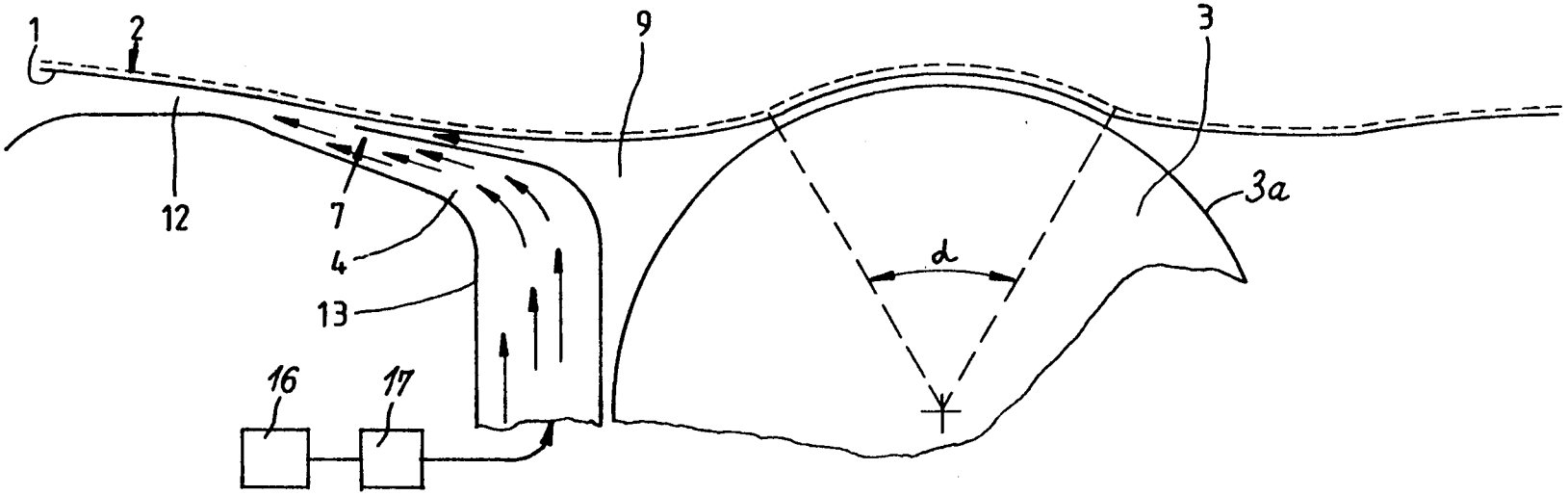
FIG. 2 is an enlarged view of a detail within and adjacent the broken-line circle II in FIG. 1.

The apparatus which is shown in the drawing comprises one or more idler guide rollers 3 (FIG. 1 shows two idler rollers) which are adjacent one side (namely the uncoated underside) of a web- or strip-shaped substrate 1 advancing along an elongated path in the direction of arrow 14 so that it contacts at least the highest portions of peripheral surfaces 3a of the rollers 3. The axes of the rollers 3 are assumed to be substantially horizontal and to extend transversely of the direction of movement of the substrate 1. The upper side of the running substrate 1 carries one or more layers 2 of a coating material, e.g., an adhesive which contains an evaporable solvent. The solvent should be expelled before the substrate 1 is subjected to further treatment, e.g., slitting into narrower webs, subdivision into sections of predetermined length and/or others.

The apparatus further comprises means for directing a compressed gas (e.g., heated air) against the uncoated underside of the running substrate 1 immediately or closely upstream and downstream of each guide roller 3 or immediately or closely upstream and downstream of at least one of the guide rollers. The gas, which is discharged by the orifices of pairs of venturi nozzles, 7, 8 (hereinafter called venturis) is assumed to be a heated gas which is intended to expel solvent from the layer 2 at the upper side of the substrate 1. The venturis 7, 8 respectively receive compressed gas from plenum chambers 4, 6 which, in turn, receive compressed gas from a suitable source 16. The gas can be conditioned (heated or cooled) at 17 prior to admission into the plenum chambers 4 and 6.

The venturis 7, 8 of each pair are preferably mirror images of each other with reference to a plane which includes the axis of the respective guide roller 3 and extends transversely of the direction (arrow 14) of advancement of the substrate 1. The orifice or orifices of each venturi 7 (i.e., of the venturi upstream of the respective guide roller 3) discharge compressed gas counter to the direction which is indicated by the arrow 14, and the orifice or orifices of each venturi 8 (downstream of the respective roller 3) discharge compressed gas in the direction of arrow 14. The streams of accelerated compressed gas produce a well-known venturi effect, i.e., the pressure in the chambers 9 and 11 immediately upstream and immediately downstream of the topmost portions of the peripheral surfaces 3a of the respective guide rollers 3 drops below atmospheric pressure so that the underside of the running substrate 1 is attracted to the peripheral surfaces 3a along relatively large arcs or angles alpha (e.g., each angle alpha can be in the range of 90°). This ensures that the running substrate 1 can rotate the idler guide rollers 3 without any slippage to thus ensure gentle treatment of the substrate during advancement along the path which extends along the topmost portions of the peripheral surfaces 3a. The (subatmospheric) pressure in the chambers 9 and 11 is substantially constant in order to ensure the establishment of a predetermined large-area contact between the uncoated underside of the substrate 1 and the peripheral surfaces 3a of the guide rollers 3. Symmetrical distribution of the pairs of venturis 7, 8 relative to the respective guide rollers 3 contributes to the establishment of a predictable area of contact between the substrate and the peripheral surfaces 3a.

It is not necessary to provide any means for driving the idler roller or rollers 3 because the absence of slippage between the substrate 1 and the peripheral surfaces 3a ensure rotation of the idler rollers at a peripheral speed which matches the speed of advancement of the substrate along its path. The absence of any drive means for the rollers 3 contributes to a reduction of the initial and maintenance cost and to simplicity of the improved apparatus. The streams of gaseous fluid which are discharged by the orifices of the venturis 7, 8 actually carry (at 12) the adjacent portions of the running substrate 1.

The supplied gaseous fluid is evacuated from the apparatus at the evacuating or withdrawing chambers 13.

The reference character 18 denotes a device (e.g., a motor-driven pulley) which can advance the substrate at any one of two or more different speeds. The angles alpha can be increased, without changing the pressure of gas which issues from the orifices of the venturis 7 and 8, by the simple expedient of increasing the speed of the substrate 1 along its path.

If the gas is to expel moisture from the layer 2 at the upper side of the substrate 1, such expulsion can progress in a highly satisfactory and predictable manner because the gas impinges upon the uncoated underside of the substrate to thus avoid the development of a hardened film of coating material at the exposed upper side of the layer 2. Thus, the drying action can proceed from the underside toward the upper side of the layer 2, i.e., from the inside toward the outside, which has been found to be highly desirable and advantageous in most instances.

If the layer or layers 2 are applied against the underside of the substrate 1 (this is customary in many presently known coating or laminating apparatus), the apparatus which is shown in the drawing can be turned upside down, i.e., the guide rollers 3 are then located at the uncoated upper side of the running substrate, the same as the venturis 7 and 8.

Apparatus which can be used to apply one or more layers to running web- or strip-shaped substrates are disclosed, for example, in commonly owned U.S. Pats. Nos. 4,764,402 and 4,886,564.

An important advantage of the improved apparatus is that the substrate 1 and its layer or layers 2 are treated gently. The path of the substrate 1 is a substantially straight path with some deviations at the peripheries of the guide rollers 3. Another advantage of the improved apparatus is that the guide roller or rollers 3 need not be driven by a separate drive because they can be rotated in a predictable manner by the running substrate 1. A further advantage of the improved apparatus is that the expulsion of moisture from the substrate 1 and/or from the layer or layers 2 can be effected in an efficient and highly predictable manner Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for treating a coated web-shaped running substrate which has a coated side and an uncoated side and is advanced in a predetermined direction along a predetermined path, comprising at least one rotary idler roller adjacent a predetermined portion of said path at the uncoated side of the substrate; means for directing a compressed gas against the uncoated side of the substrate adjacent said at least one idler roller upstream and downstream of said predetermined portion of said path, including a first venturi upstream and a second venturi downstream of said predetermined portion of said path, said first venturi having at least one orifice which discharges gas counter to said direction and said second venturi having at least one orifice which discharges gas in said direction; and means for conditioning the gas before the gas contacts the uncoated side of the substrate in said path.

2. The apparatus of claim 1, wherein said conditioning means including means for heating the gas.

3. The apparatus of claim 1, wherein said conditioning means includes means for cooling the gas.

4. The apparatus of claim 1, wherein said venturis are mirror images of each other with reference to a plane crossing said path and including the axis of rotation of said idler roller.

5. The apparatus of claim 1, further comprising means for pulling the substrate along said path at a variable speed.

6. The apparatus of claim 1, wherein said idler roller has a peripheral surface and defines with said venturis first and second suction chambers adjacent said peripheral surface upstream and downstream of said predetermined portion of said path so that suction in said chambers attracts the uncoated side of the substrate and said uncoated side contacts a substantial portion of said peripheral surface to rotate said roller without slippage relative to the substrate.

7. The apparatus of claim 6, wherein said path is located above said idler roller.

* * * * *